US006565081B1

(12) United States Patent
Perez et al.

(10) Patent No.: US 6,565,081 B1
(45) Date of Patent: May 20, 2003

(54) MEDIA OUTPUTTING DEVICE AND METHOD FOR OUTPUTTING MEDIA

(75) Inventors: Francisco Javier Perez, Barcelona (ES); David Claramunt, Barcelona (ES); Jesus Garcia, Barcelona (ES); Xavier Gros, Barcelona (ES)

(73) Assignee: Hewlett-Packard Company, Palo Alto, CA (US)

( * ) Notice: Subject to any disclaimer, the term of this patent is extended or adjusted under 35 U.S.C. 154(b) by 47 days.

(21) Appl. No.: 10/002,970

(22) Filed: Oct. 26, 2001

(51) Int. Cl.[7] ..... B65H 29/60
(52) U.S. Cl. ..... 271/183
(58) Field of Search ..... 271/183, 207, 271/208, 209, 210, 211, 212, 213, 214, 215, 216, 217, 218, 219, 220, 221, 222, 223, 224, 283

(56) References Cited

U.S. PATENT DOCUMENTS

| | | | | | |
|---|---|---|---|---|---|
| 4,216,954 | A | * | 8/1980 | Kwasnitza | 271/283 |
| 4,693,462 | A | * | 9/1987 | Pollich | 271/183 |
| 4,966,521 | A | * | 10/1990 | Frye et al. | 414/788.8 |
| 5,074,547 | A | * | 12/1991 | Smith et al. | 271/283 |
| 6,234,472 | B1 | | 5/2001 | Juan | 271/194 |

* cited by examiner

*Primary Examiner*—Donald P. Walsh
*Assistant Examiner*—Kenneth W Bower

(57) ABSTRACT

A media outputting device for a hardcopy apparatus includes a media source and at least one roller having an outer surface with a contact region for engaging media, where the roller is rotatable for outputting the media. The media outputting device also includes a negative pressure mechanism for creating a negative pressure distribution on the contact region where at least one portion of the contact region that is farther from the media source has a greater negative pressure than at least one portion of the contact region that is closer to the media source.

12 Claims, 7 Drawing Sheets

MEDIA OUTPUTTING DEVICE AND METHOD FOR OUTPUTTING MEDIA

BACKGROUND OF THE INVENTION

1. Field of the Invention

The present invention generally relates to a hardcopy apparatus, such as copiers, printers, scanners, and facsimiles, and more particularly to improved media outputting devices for such apparatus.

2. Description of the Prior Art

In a hardcopy apparatus and particularly in apparatus handling media of big size, such as large format printers, printed media is outputted from the printer by means of outputting devices that may damage the quality of the printout. Conventional outputting devices, in order to advance the printed media, employ elements for holding the media having direct contact with the printed surface. This may cause markings on the media, ink smearing and other adverse affects on the print appearance.

As an example, the prior art has employed star wheel overdrives for outputting printed media. These devices may damage the printout with star wheel marks and further require the need to employ a mechanism or a structure to hold the star wheels.

To overcome the problem of adverse affects on the print media appearance, U.S. Pat. No. 6,234,472 discloses a media holddown device comprising a vacuum holddown output unit for holding at least a portion of the media down onto a surface of the outputting mechanism. Thus, Patent '472 allows holding of the print media without direct contact with the printed surface. The vacuum holddown output unit includes a platen having a continuous waved slot that allows for even distribution of the vacuum along the print zone and a plurality of overdrive wheels with a gap between the overdrive wheels and the surrounding platen, in which a vacuum is also generated. Patent '472 requires a vacuum that holds the print media tightly against the platen and also against the overdrive wheels. However, this vacuum undesirably increases the friction force on the platen, resulting in a lower traction force for the overdrive wheels. It also requires an increased vacuum level that is primarily used for holding the print media against the platen.

The present invention has the advantage of providing an improved media outputting device and method for outputting a printed media from a hardcopy apparatus, with an increased traction force. The present invention has the further advantages of requiring lower vacuum levels and providing a more accurate paper advance due to less friction force on the platen which does not have a vacuum distribution on

SUMMARY OF THE INVENTION

A media outputting device comprising: a media source; at least one roller having an outer surface with a contact region for engaging media where the roller is rotatable for outputting the media; and a negative pressure mechanism which is capable of creating a negative pressure distribution on the contact region wherein at least one portion of the contact region that is farther from the media source has a greater negative pressure than at least one portion of the contact region that is closer to the media source.

Preferably, the negative pressure distribution is created by a first and a second vacuum channel, the first channel running axially along the edge of the contact region closest to the media source and the second channel running along the opposite edge of the contact region wherein the width of the second channel is greater than the width of the first channel. More preferably, the negative pressure distribution is a linear distribution.

The present invention will be described further, by way of example only, with reference to an embodiment thereof as illustrated in the accompanying drawings.

DESCRIPTION OF THE PREFERRED EMBODIMENT

Figure 1:
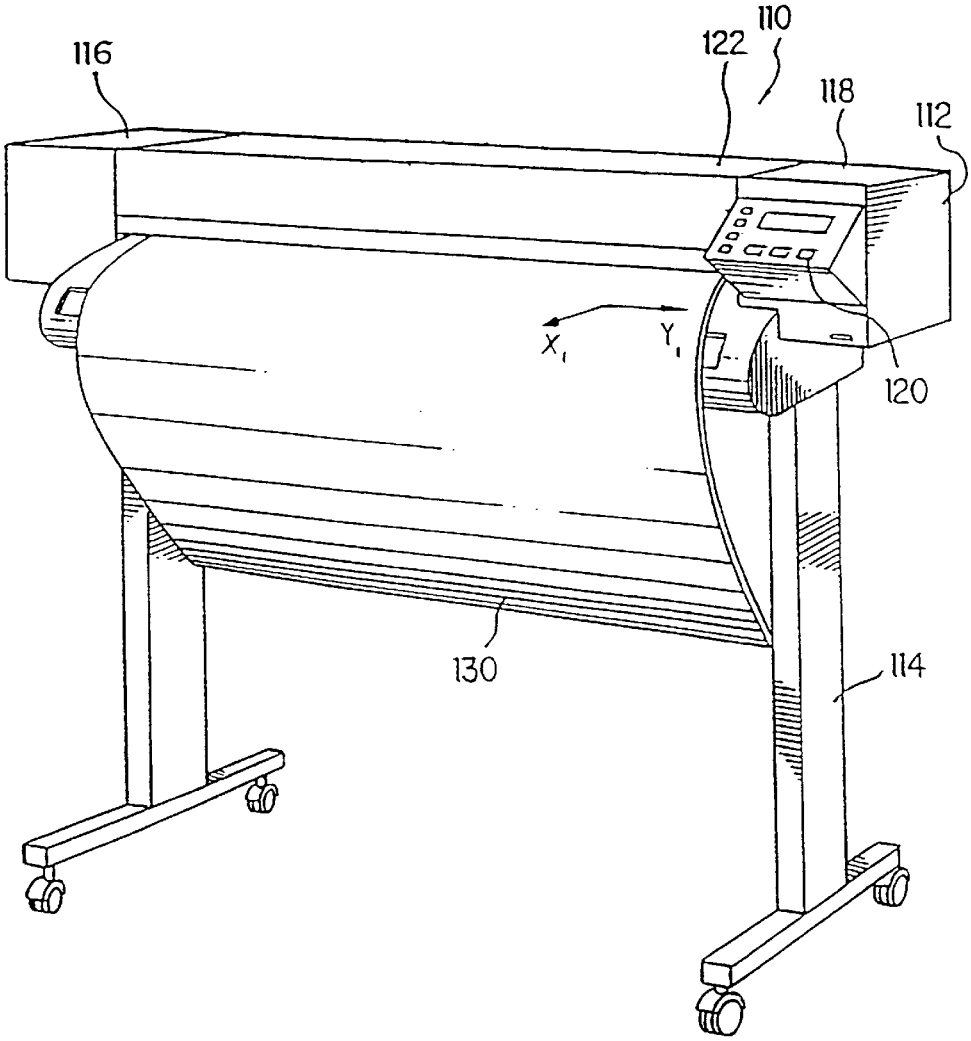
FIG. 1 is a perspective view of an inkjet printer incorporating the features of the present invention.

Referring to FIG. 1, a printer 110 includes a housing 112 mounted on a stand 114. The housing has left and right drive mechanism enclosures 116 and 118, and a cover 122. A control panel 120 is mounted on the right enclosure 118. A print media 130, such as paper, is positioned along a media axis denoted as the $X_1$ axis. A second axis, perpendicular to the $X_1$ axis, is denoted as the $Y_1$ axis.

Figure 2:
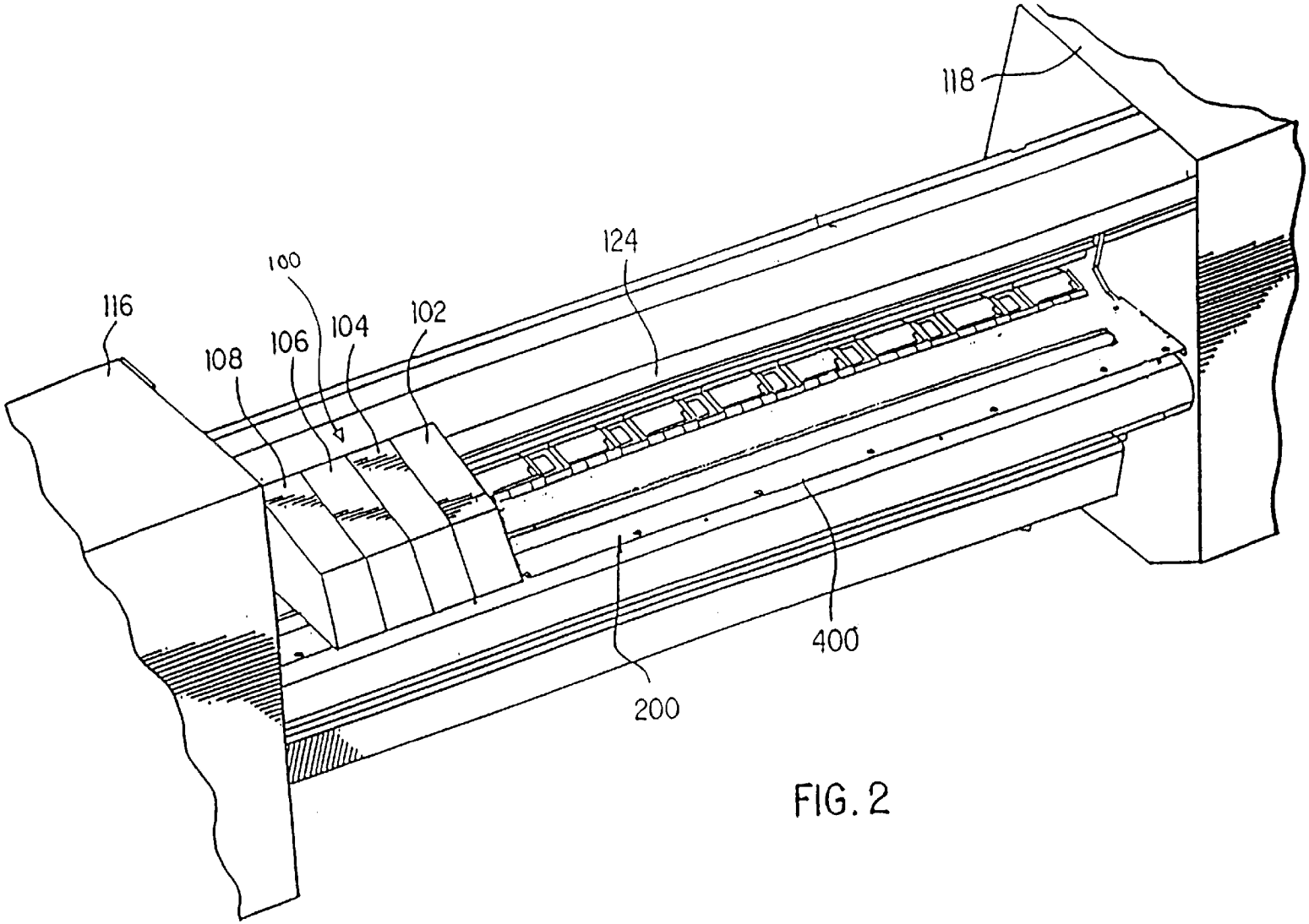
FIG. 2 is a diagram of a media outputting device of the printer of FIG. 1.

Referring now to FIG. 2, a media outputting device is globally referenced as 200. The outputting device 200 is located between the left and right drive mechanism enclosures 116 and 118. The width of the outputting device 200 measured along the $Y_1$ axis (shown in FIG. 1) is at least equal to the maximum allowable width of the media. In this embodiment, the width of the outputting device 200 should allow the advancement of media having width up to 36 inches, i.e. 914 mm. However, a larger or smaller media may be advanced according to the capabilities of the hardcopy apparatus in which the media outputting device is being utilized.

A carriage assembly 100 is adapted for reciprocal motion along a carriage bar 124. The carriage assembly 100 comprises four inkjet printheads 102, 104, 106, 108, each having printhead nozzles and adapted to store ink of different colors, e.g., black, magenta, cyan and yellow ink, respectively. Inkjet printheads 102, 104, 106, 108, are held rigidly in the movable carriage 100 so that the nozzles are above the surface of a portion of the media 130 that lays substantially flat on a flat stationary platen 400. As the carriage assembly 100 moves relative to the media 130 along the $X_1$ and $Y_1$ axis (shown in FIG. 1), selected nozzles of the printheads 102, 104, 106, 108 are activated and ink is applied to the media 130. The colors from the color printheads are mixed to obtain any other particular color.

Figure 3:
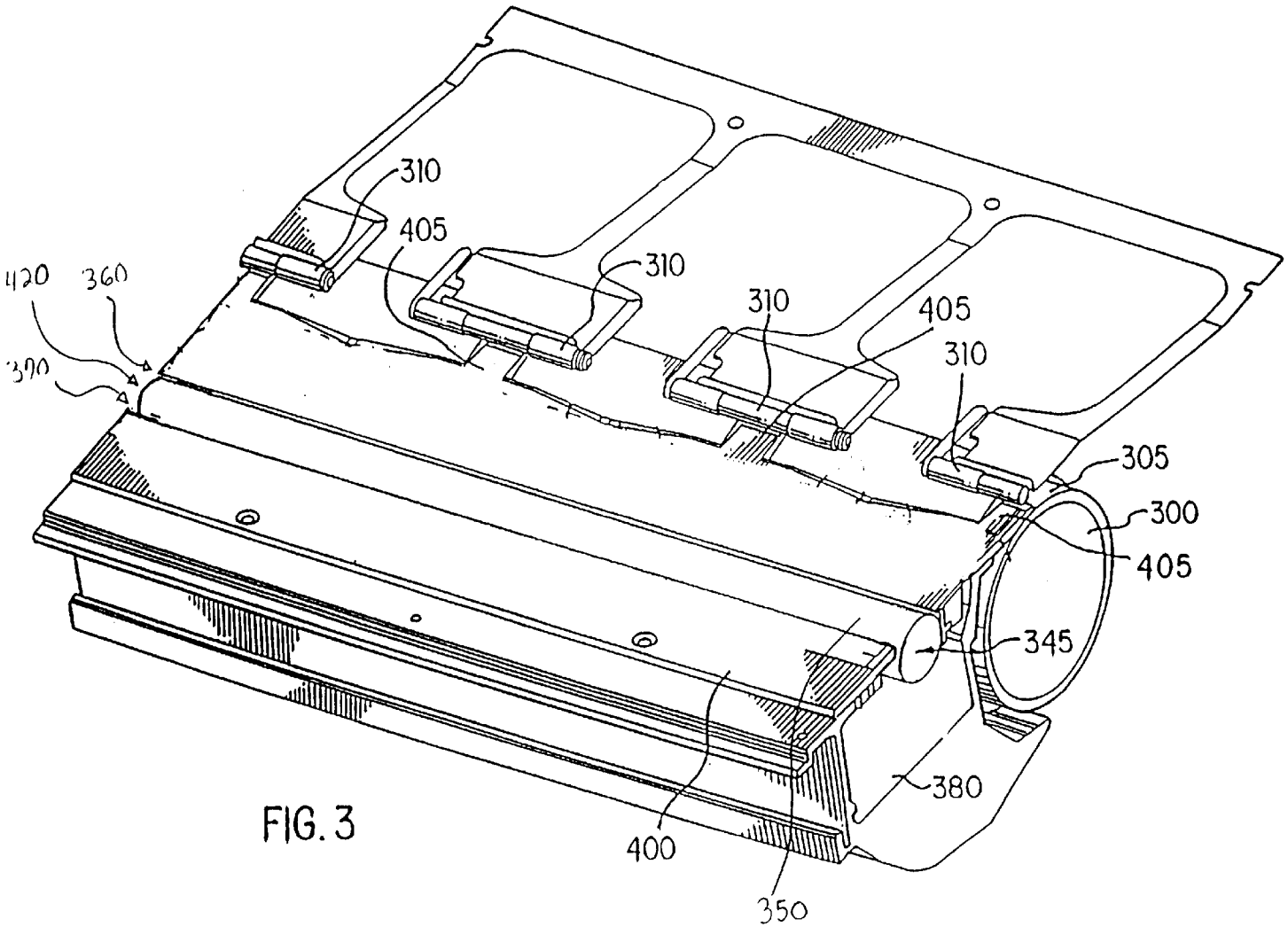
FIG. 3 depicts a cutaway, perspective view of a portion of the media outputting device of FIG. 2.

Referring to FIG. 3, the platen 400 is shown in more detail. The platen 400 is a flat surface that extends from the front of the printer 110 to a main driving roller 300. The platen 400 has a slot 420 extending along the $Y_1$ axis about a length equal to, or slightly less than the maximum allowable width of the media. The slot 420 partially houses the overdrive roller 345 which will be discussed later in more detail. A plurality of pinch wheels 310 are positioned above the platen 400 and are controlled to periodically index or convey the media 130 across the surface of the platen 400. In this embodiment there are 12 pinch wheels 310 (shown in FIG. 2). However, the number of pinch wheels may be more or less according to the hardcopy apparatus being utilized. The force between each pinch wheel 310 and the main roller 300 is preferably between 3.33 N and 5 N, and more preferably 4.15 N. This pinch wheel distribution and force help to drive the media 130 straight with irrelevant lateral slippage.

The main roller 300 has an outer surface having a plurality of circumferencial recesses 305 housing a corresponding plurality of protrusions 405 of the platen 400. The protrusions 405 extend from the rear of the platen 400 towards the rear of the printer 110. This combination of features allows the media 130 to reliably move between the main roller 300 and the platen 400, establishing a media source.

Figure 4:
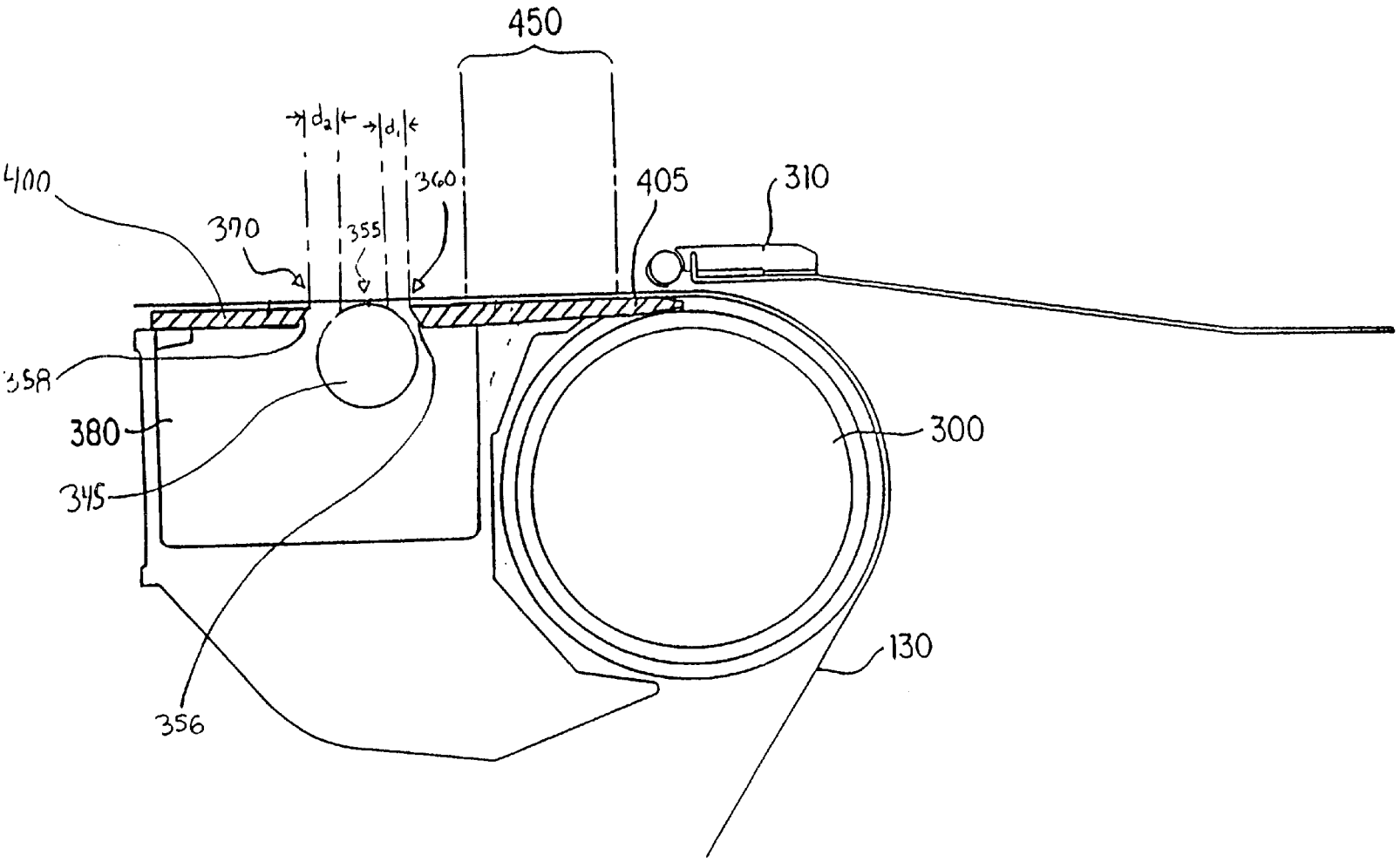
FIG. 4 is a cross-sectional view of the media outputting device of FIG. 2.

Referring to FIGS. 3 and 4, the media outputting device 200 comprises an overdrive roller 345, first and second vacuum channels 360 and 370, and a vacuum chamber 380. The overdrive roller 345 is cylindrical in shape and is rotatably mounted partially within slot 420 of platen 400. Overdrive roller 345 has a length slightly less than the length of slot 420 and an outer surface 350 having a contact region 355. Although this embodiment of outputting device 200 has a continuous overdrive roller 345 that extends almost the length of slot 420 in order to supply equal traction to each part of the media 130, a plurality of rollers, in strict contact with one another or separated from one another, may also be employed. The overdrive roller 345 is positioned in front of the print zone 450 towards the front of printer 110.

Running axially along overdrive roller 345 are first and second vacuum channels 360 and 370. First channel 360 is formed between edge 356 of platen 400 and roller 345, and second channel 370 is formed between edge 358 of platen 400 and roller 345, such that first channel 360 is closer to main driving roller 300 than second channel 370. First channel 360 has a width d1 measured along the $X_1$ axis and second channel 370 has a width d2 measured along the $X_1$ axis, such that width d2 is greater than width d1. Preferably, width d2 is greater than width d1 by the ratio of about 3:2 to 9:1.

In this embodiment, first and second channels 360 and 370 are above vacuum chamber 380 and are in fluid communication with the vacuum chamber. Vacuum chamber 380 is further in fluid communication with a vacuum source, which in this embodiment is a fan that is not shown in the drawings.

Contact region 355 of roller 345 is that area of the roller 345 that is located between first and second vacuum channels 360 and 370, and which engages the back of media 130. As a result of the vacuum created by the vacuum source from atmosphere through the first and second vacuum channels 360 and 370, a negative pressure distribution is created upon the overdrive roller 345 in the area of the contact region 355. The negative pressure distribution causes the back of media 130 to engage with contact region 355.

Figure 5:
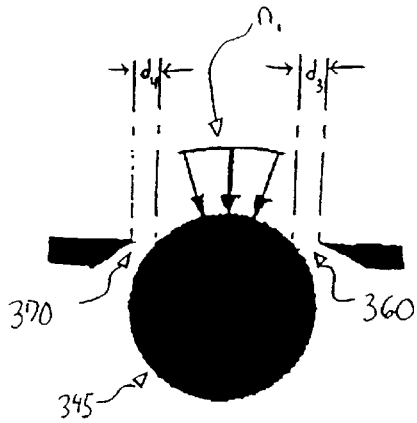
FIG. 5 is a schematic diagram of the roller of FIG. 4 showing a linear negative pressure distribution.

Referring to FIG. 5, an overdrive roller 345 is shown with a constant negative pressure distribution $n_1$. Constant negative pressure distribution n, causes the back of media 130 to frictionally engage overdrive roller 345. A traction force results that allows overdrive roller 345 to advance media 130 when the roller is rotated. The constant negative pressure distribution $n_1$ is created by having equal widths d3 and d4 of the corresponding vacuum channels 360 and 370.

For the constant negative pressure distribution $n_1$, the traction force is determined as follows:

$$\frac{dT(\theta)}{d(\theta)} = -\mu \cdot [V(\theta) \cdot R + T(\theta)]$$

where:

$T(\theta)$=the traction force, $V(\theta)$=the negative pressure distribution, $\mu$=the coefficient of friction, and R=the radius of the roller.

For a constant distribution, $V(\theta)=V$ where $\alpha$=the wrapped angle. Thus, the traction force for a constant distribution is $T(\theta)=V \cdot R \cdot (e^{\xi}-1)$, where $\xi=\mu\alpha$.

Figure 6:
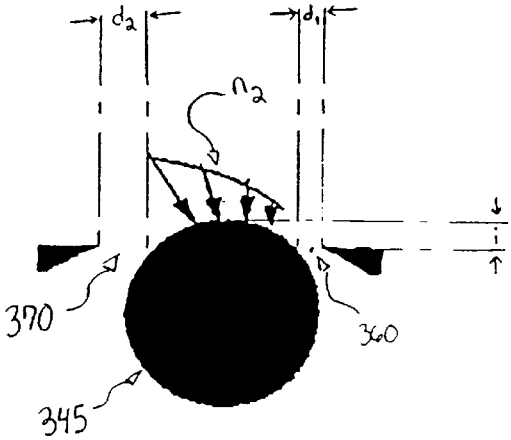
FIG. 6 is a schematic diagram of the roller of FIG. 4 showing a constant negative pressure distribution.

Referring to FIG. 6, in order to increase the traction force provided by the overdrive roller 345 upon the back of media 130, the media outputting device 200 of the present invention creates a negative pressure distribution $n_2$ upon the roller 345 whereby at least one portion of the contact region 355 that is farther from the main driving roller 300, i.e., the media source, has a greater negative pressure than at least one portion of the contact region that is closer to the main driving roller. One such example of a non-constant negative pressure distribution is a linear distribution.

For the non-constant negative pressure distribution $n_2$, the traction force is also determined as follows:

$$\frac{dT(\theta)}{d(\theta)} = -\mu \cdot [V(\theta) \cdot R + T(\theta)]$$

and for a linear negative pressure distribution:

$$V(\theta) = \frac{2 \cdot \theta}{\alpha} \cdot V$$

This results in a traction force for a linear distribution of $T(\theta)=2 \cdot V \cdot R \cdot (e^{\xi}(1-1/\xi)+1/\xi)$, where $\xi=\mu\alpha$.

Depicted in FIG. 6, this embodiment seeks to create a linear negative pressure distribution $n_2$ upon roller 345 by unequal widths of vacuum channels 360 and 370 wherein the width d2 of second channel 370 is greater than the width d1 of first channel 360.

Although the negative pressure distribution, and preferably a linear negative pressure distribution, upon overdrive roller 345 is achieved through use of unequal channel widths in this embodiment, it should be understood that other negative pressure mechanisms may be employed to achieve the same results including having a plurality of vacuum sources causing unequal vacuum levels through vacuum channels 360 and 370. Preferably, the ratio of the vacuum in vacuum channel 370 to the vacuum in vacuum channel 360 is about 3:2 to 9:1.

Figure 7:
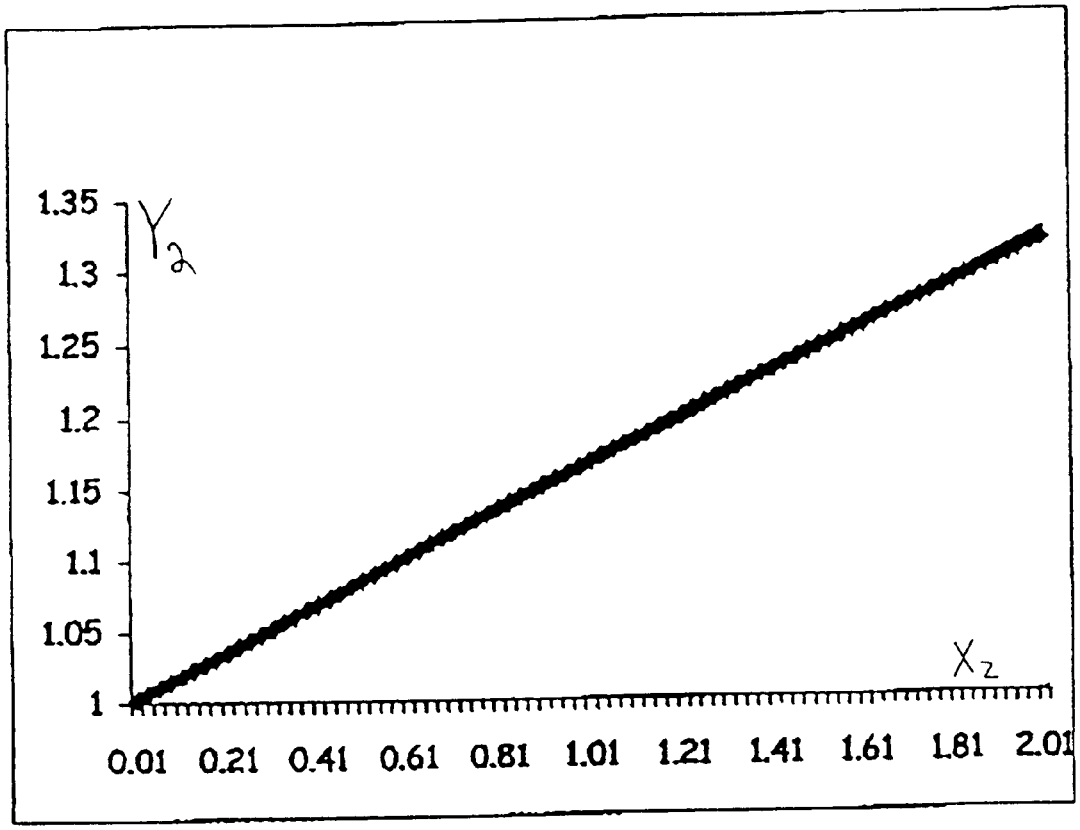
FIG. 7 is a graph plotting the improved traction force through a comparison of the ratio of traction force for linear distribution to constant distribution for a range of coefficients of friction and wrapped angles.

Referring to FIG. 7, the improvement in traction force is represented graphically through a comparison of $\xi$ along the $X_2$ axis versus the ratio of traction force for a linear distribution to a constant distribution along the $Y_2$ axis, where $Y_2$ is:

$$2\cdot\frac{\xi+e^{-\xi}-1}{\xi\cdot(1-e^{-\xi})}$$

As shown in FIG. 7, for a typical value of ξ of 1.6, there is about a 26% increase of traction force for the linear distribution as compared to the constant distribution.

The traction force, resulting from the negative pressure distribution, between media 130 and overdrive roller 345 is preferably between 0.6 N and 1 N, and more preferably 0.8 N, depending upon the values of α, v, $d_1$ and $d_2$.

Referring to FIG. 6, to transmit the proper traction force to the media 130, the overdrive interference i, i.e., the distance the top of the overdrive roller 345 extends above the surface of the platen 400, is preferably between 0.3 mm and 0.6 mm. Testing has revealed that below 0.25 mm the traction force reduces rapidly, towards zero traction force at zero interference; while an interference larger than 0.65 mm may result in wrinkles created by the overdrive roller 345 extending to the print zone 450.

The media outputting device 200 utilizes a negative pressure distribution upon the overdrive roller 345 to create the necessary traction force for advancement or outputting of the media 130. By removing the negative pressure distribution from the platen 400, outputting device 200 is not required to overcome undesirable friction forces on the platen as the media 130 is advanced. This allows for higher traction forces on the overdrive roller 345. Additionally, by removing undesirable friction forces on the platen 400, the outputting device 200 has a more accurate paper advance since the uncontrolled friction forces have been decreased. Also, in this embodiment the vacuum source creating the negative pressure distribution on the overdrive roller 345 requires less vacuum power because the vacuum is used only for the overdrive roller and not the platen 400. Thus, the vacuum is required to be distributed over a smaller area.

Outputting Operation

Figure 8:
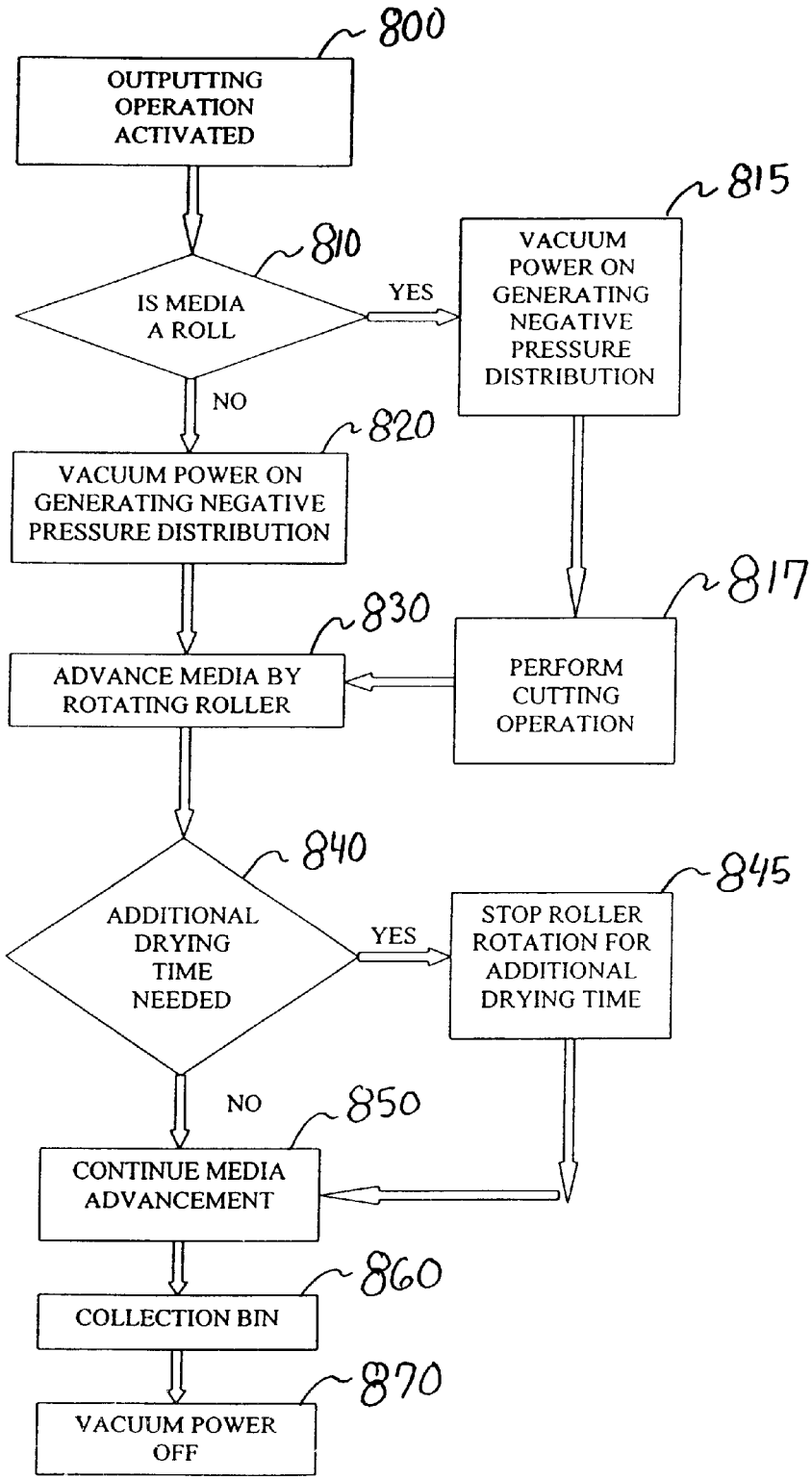
FIG. 8 is a flow chart depicting a method for outputting media according to the apparatus of FIG. 2.

Referring to FIG. 8, an outputting operation may be activated either automatically when a printing operation has been completed or aborted, or manually by a user's request, as shown in step 800.

When the outputting operation is activated, the printer 110 verifies if the media 130 to be outputted is a cut sheet or a roll (step 810). If the media 130 is a roll a cutting step is performed. This means that the media 130 is advanced to the cutting position and the vacuum source is powered on resulting in a non-constant negative pressure distribution on the overdrive roller 345 in order to tension the media and hold the media substantially flat while minimizing movement (step 815). This allows a blade (not shown) to traverse the media 130 along the $Y_1$ axis to cut the media, as shown in step 817.

Once the roll has been cut or if the media 130 is a cut sheet, the media is advanced along the $X_1$ axis towards the front of the printer 110 away from the main roller 300 (step 830).

The advancement of the media is performed by engagement of a portion of the back of the media 130 with the contact region 355, due to the negative pressure generated by the vacuum source, and rotation of the overdrive roller 345. The negative pressure distribution on overdrive roller 345 is non-constant and results in an increased traction force between the media 130 and the overdrive roller. Additionally, this has the advantage of requiring lower vacuum levels and more accurate paper advance due to less friction force on the platen 400 because the negative pressure distribution is on the overdrive roller 345 and not on platen 400.

If the ink printed onto the media 130 requires additional drying time (step 840), the overdrive roller rotation may be stopped when most of the printout is advanced out of the printer (step 845), e.g., as shown in FIG. 1. The vacuum source is kept on for the required time to tension the media 130 and assist in drying.

The media 130 can then continue its advancement or output from the printer 110 as shown in step 850, preferably into a conventional collecting bin (step 860). The vacuum source is then powered off, as shown in step 870.

The present invention having thus been described with particular reference to the preferred forms thereof, it will be obvious that various changes and modifications may be made therein without departing from the spirit and scope of the present invention as defined in the appended claims. Furthermore, the skilled in the art will appreciate that, in accordance with this preferred embodiment, the same media outputting device may be capable of being employed to perform a plurality of different operations, such as loading and feeding operations, through use of the above-described "non-constant" negative pressure distribution.

What is claimed is:

1. A media outputting device for a hardcopy apparatus comprising:

a media source;

at least one roller having an outer surface with a contact region for engaging media from said media source and rotatable for outputting said media; and a negative pressure mechanism which creates a negative pressure distribution on said contact region wherein at least one portion of said contact region that is farther from said media source has a greater negative pressure than at least one portion of said contact region that is closer to said media source.

2. The media outputting device according to claim 1, wherein said negative pressure distribution is a linear distribution.

3. The media outputting device according to claim 1, wherein said negative pressure mechanism comprises at least one vacuum source and at least one vacuum channel, said at least one vacuum channel running axially along at least a portion of said contact region.

4. The media outputting device according to claim 3, wherein said at least one vacuum channel is partially defined by a portion of said at least one roller.

5. The media outputting device according to claim 3, wherein said at least one vacuum source is connected to the atmosphere.

6. The media outputting device according to claim 3, wherein said at least one vacuum channel comprises a first and a second channel, said first channel running along an edge of said contact region and said second channel running along an opposite edge of said contact region, said first channel being located closer to said media source than said second channel.

7. The media outputting device according to claim 6, wherein said second channel has a width greater than said first channel.

8. The media outputting device according to claim 7, further comprising a traction force on said contact region, a coefficient of friction $\mu$ between said media and said roller, and said roller further comprising a radius R and a wrapped angle α, wherein said traction force on said contact region is $2\cdot V\cdot R\cdot(e^{\mu\alpha}\cdot(1-1/\mu\alpha)+1/\mu\alpha)$ where V is said negative pressure distribution.

9. The media outputting device according to claim 7, wherein said second channel has a width greater than said first channel by the ratio of about 3:2 to 9:1.

10. The media outputting device according to claim 6, wherein said at least one vacuum source comprises a first and second vacuum source, said first vacuum source creating a first vacuum through said first channel, said second vacuum source creating a second vacuum through said second channel, wherein said second vacuum is greater than said first vacuum.

11. The media outputting device according to claim 10, wherein said second vacuum is greater than said first vacuum by the ratio of about 3:2 to 9:1.

12. A method of outputting media from a hardcopy apparatus comprising:

advancing media from a media source to contact a contact region on a roller;

generating a negative pressure distribution between said media and said contact region wherein at least one portion of said contact region that is farther away from said media source has a greater negative pressure than at least one portion of said contact region that is closer to said media source; and further advancing said media by rotating said roller.

* * * * *